US007117956B2

(12) United States Patent
Grattan et al.

(10) Patent No.: US 7,117,956 B2
(45) Date of Patent: Oct. 10, 2006

(54) PIPE CONVEYED EXPLOSIVE WITH SELF CONTAINED ACTUATION

(75) Inventors: Tony F. Grattan, Mansfield, TX (US); Richard J. Foret, Youngsville, LA (US); Michael L. Patterson, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 43 days.

(21) Appl. No.: 10/886,256

(22) Filed: Jul. 7, 2004

(65) Prior Publication Data

US 2006/0005998 A1 Jan. 12, 2006

(51) Int. Cl.
*E21B 43/11* (2006.01)
*E21B 29/10* (2006.01)

(52) U.S. Cl. ..... 175/4.6; 166/298

(58) Field of Classification Search ..... 175/2, 175/3.5, 4.6; 166/55, 63, 297, 298, 301
See application file for complete search history.

(56) References Cited

U.S. PATENT DOCUMENTS 5,505,261 A * 4/1996 Huber et al. ..... 166/297

* cited by examiner

*Primary Examiner*—George Suchfield
(74) *Attorney, Agent, or Firm*—Conley Rose, P.C.

(57) ABSTRACT

A pipe conveyed charge system, for example a junk shot, having a self-contained activating charge which may be activated by mechanical force applied through the pipe. The initiating charge is pressure actuated, and fluid pressure in the pipe is used to fire the charge. The system includes a circulating crossover coupling an explosive charge to a pipe string and including circulating ports directing fluid flow downhole to clear debris from the borehole. A ball, or other blocking material, is conveyed down the drill pipe to block circulating ports to facilitate raising pressure in the pipe to a sufficient level to fire the activating charge.

12 Claims, 3 Drawing Sheets

PIPE CONVEYED EXPLOSIVE WITH SELF CONTAINED ACTUATION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to explosive charges used in boreholes and more particularly to a pipe conveyed charge having self contained actuation.

BACKGROUND OF THE INVENTION

While drilling boreholes, various types of equipment failure may occur. Such failures may result in blocking the borehole with a heavy steel part which prevents further drilling. For example, a drill bit may break or twist off the bottom of a drill string and become stuck in the borehole. Drill bits are made of very hard materials since they are designed to drill through rock. It is difficult to impossible to reliably use another drill bit to drill through a broken bit in a well.

One method of clearing a non-drillable obstruction in a borehole has been to use a large shaped charge to break the obstruction into small pieces which can be cleared from the hole by circulating fluid and/or which can be drilled through. Such charges are commonly referred to as junk shots. Originally, a junk shot was attached to the end of a wireline and lowered to the obstruction. The wireline provided electrical connections which were used to actuate an electrically fired firing head which in turn detonated the shaped charge. The use of wirelines to deliver junk shots was often not effective for several reasons. It is often difficult to know exactly how deep a wireline has conveyed the junk shot into the borehole. The junk shot charge should be very close to the obstruction, preferably in direct contact with the obstruction. Since a wireline does not provide reliably accurate depth indications, the charge may not be properly placed. Since wireline equipment is not normally kept at a well location during drilling, it may be several days after an obstruction occurs before wireline equipment can be run down a borehole. In the meantime, solids from drilling mud, the borehole walls, etc. may settle on top of the obstruction. A column of such solids may prevent the junk shot from reaching the obstruction and can effectively shield the obstruction from the full force of the charge when it is fired. A wireline is generally only useful in generally vertical boreholes since it depends on gravity to lower the junk shot into the borehole.

In view of the problems wit using wirelines to convey junk shots into boreholes, systems were devised to convey the junk shots on the end of a drill string or other work string. Since the blockage usually occurs during drilling, a drill string is usually available. In addition, drilling mud could be circulated down the drill string to clear debris which may have settled on the obstruction. Standard practice has been to attach a junk shot to the bottom of the drill or work string without a detonator and lower the string to the desired depth while circulating mud. The use of a drill string allows accurate measurement of depth, even in horizontal boreholes. Once the charge is positioned on the obstruction, an activating charge, e.g. an electrically activated firing head, has been conveyed, typically on a wireline, down through the drill string to the main junk shot. Once it is in place, the activating charge is fired, which then fires the main junk shot. This system also has several problems. The main charge is subjected to downhole pressure and temperature for prolonged times as the activating charge is prepared and conveyed downhole. These conditions may cause failure of the main charge. The extra time and equipment needed to convey the activating charge into the borehole greatly increases the cost of the operation.

SUMMARY OF THE INVENTION

The present invention provides a pipe conveyed charge system having a self contained activating charge which may be activated by mechanical force applied through the pipe in a one trip operation.

In one embodiment, the initiating charge is pressure actuated, and fluid pressure in the pipe is used to fire the charge.

In one embodiment, the system includes a circulating crossover coupling an explosive charge to a pipe string and including circulating ports directing fluid flow downhole to clear debris from the borehole.

In one embodiment, a ball, or other blocking material, is conveyed down the drill pipe to block circulating ports to facilitate raising pressure in the pipe to a sufficient level to fire the initiating charge.

DETAILED DESCRIPTION OF THE PREFERRED EMBODIMENTS

In this disclosure, a junk shot system is described as being conveyed downhole on pipe. The term "pipe" or "pipe string" is intended to include conventional drill pipe or other work string pipe made up of a number of lengths of pipe connected together by threaded couplings. However, pipe may also refer to coiled tubing, especially when drilling in wells with horizontal sections which are often drilled using coiled tubing. In any case, the pipe provides mechanical support for conveying a junk shot into a borehole to a desired location and provides a conduit through which fluid may be pumped, and in some embodiments through which a mechanical device may be conveyed downhole. The term "downhole" is used in its normal sense as used in drilling of wells. Conveying a tool downhole means moving the tool through the well from the surface location of the well toward the opposite end of the well. For vertical wells, downhole means a position in the well below the surface location. For wells with slanted or horizontal portions, movement downhole may include lateral displacement from the surface location.

Figure 1:
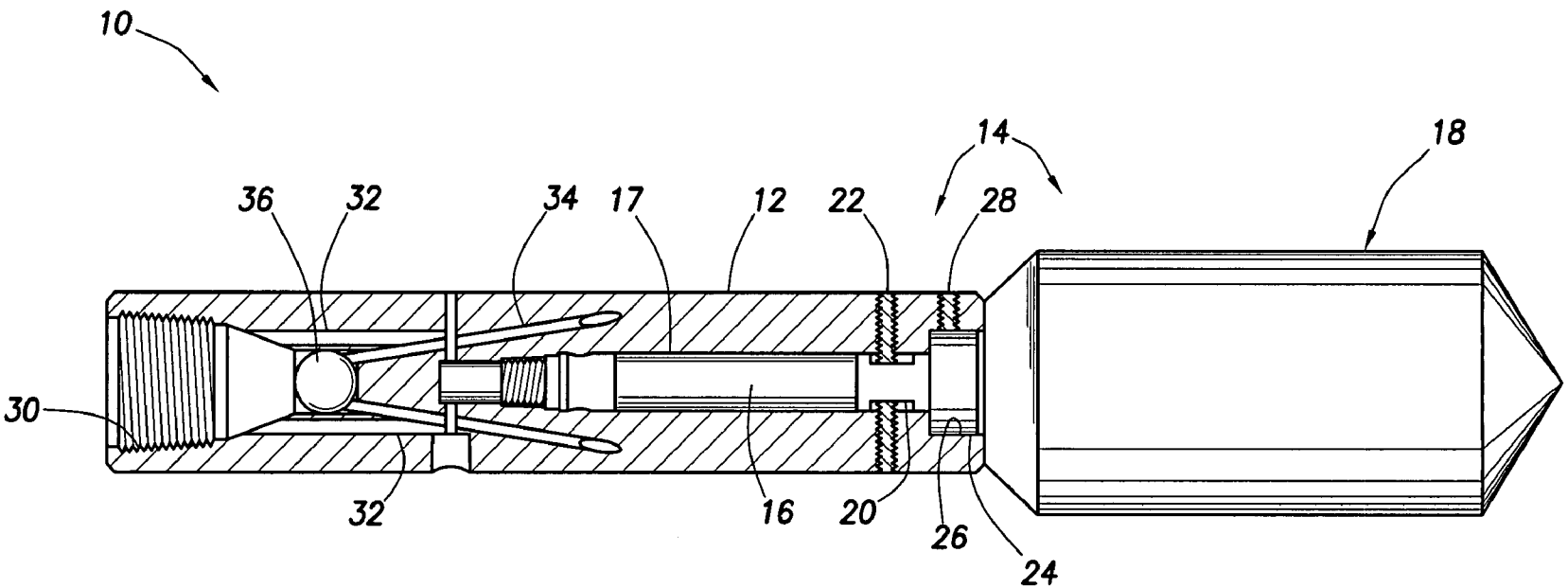
FIG. 1 is a partially cross sectional view of an assembled junk shot according to one embodiment of the invention.

FIG. 1 illustrates a junk shot assembly 10 according to an embodiment of the invention. The assembly includes two main portions, a circulating crossover 12, shown in more detail in FIGS. 2 and 3, and a charge assembly 14. The charge assembly 14 includes a pressure actuated firing head 16, shown in more detail in FIG. 4, which is carried in a central bore 17 in the crossover 12, and a large shaped charge 18. The firing head 16 and shaped charge 18 are connected together by an adapter 20, shown in more detail in FIG. 5, which also prevents any part of the firing head 16 from dropping out of the crossover 12 after the charge assembly 14 has been fired. The crossover 12 has four threaded bores 22 aligned with the adapter 20, for insertion of setscrews which limit the movement of the adapter. A threaded extension 24 on shaped charge 18 is threaded into a threaded bore 26 in one end of the crossover 12. A set screw 28 is provided in crossover 12 to prevent the shaped charge 18 from being unthreaded from the bore 26.

On an end of the crossover 12 opposite the charge 18 is provided an internally threaded coupling 30 adapted for connection to a conventional drill string or work string pin coupling, i.e. a male threaded connector. Two bores 32 provide fluid communication from the coupling 30 to the central bore 17 of the crossover 12. Four circulating or jetting ports 34 are provided extending from the coupling 30 to the exterior surface of the crossover 12. In FIG. 1, a ball 36 is illustrated in the lower or interior end of the coupling 30, blocking the jetting ports 34, but not the bores 32.

Figure 2:
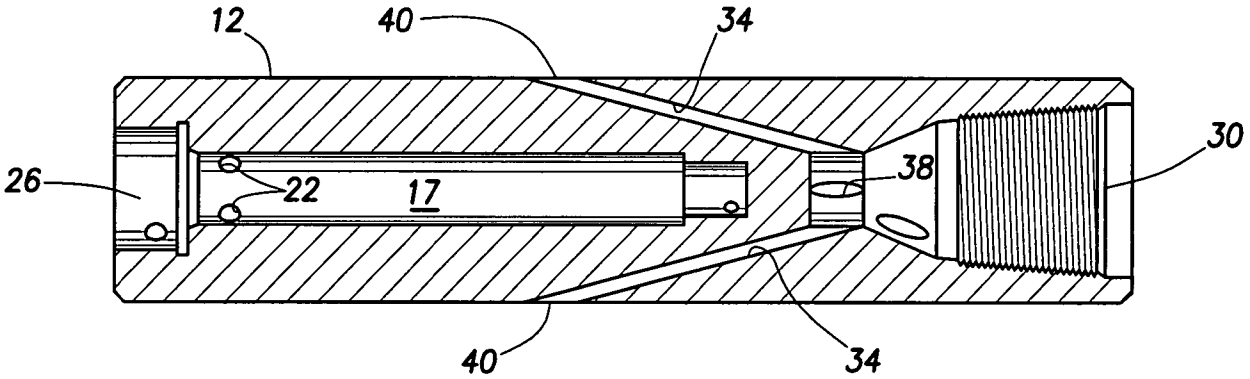
FIGS. 2 and 3 are cross sectional views of a circulating crossover according to an embodiment of the invention.

FIG. 2 illustrates more details of the crossover 12 and particularly the circulating or jetting ports 34. The jetting ports 34 extend from openings 38 at the inner most end of the coupling 30 to openings 40 on the outer surface of the crossover 12. The positioning of the openings 38 allows them to be blocked by the ball 36 when it is dropped into the coupling 30. As illustrated, the ports 34 are at a shallow angle relative to the centerline of the crossover 12. In this embodiment, there are four ports 34 distributed evenly, i.e. at 90 degree intervals, around the crossover 12. More or less ports and other radial distributions may be used if desired. The ports 34 are positioned and angled so that fluid pumped into the coupling 30 will be jetted through the ports 34 generally downhole against a borehole wall, but will preferably not directly impinge upon the shaped charge 18, which normally has a relatively soft metal case or housing.

Figure 3:
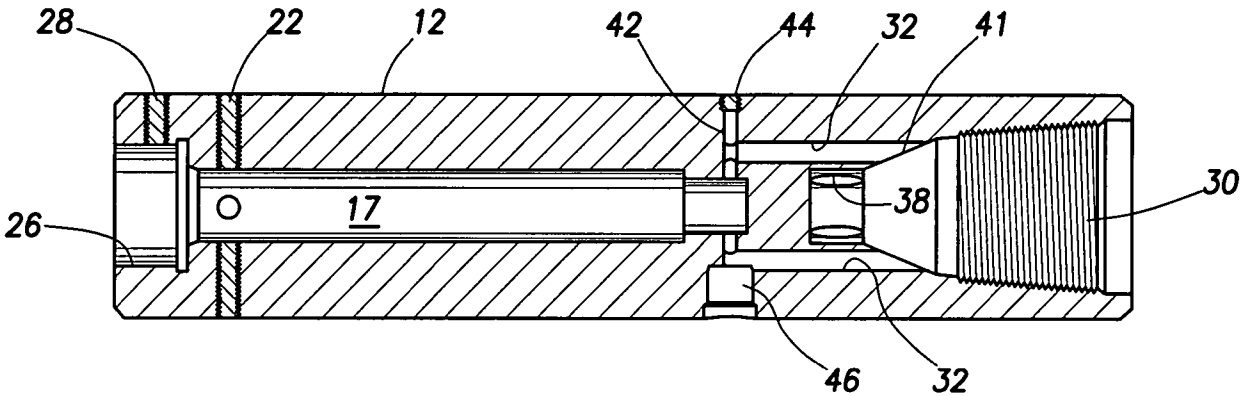

FIG. 3 illustrates more details of the crossover 12 and particularly the ports 32. The ports 32 provide fluid communication between the coupling 30 and the central bore 17. The ports 32 open into the coupling 30 at a location 41 above the location of the jetting port openings 38, so that the ports 32 are not blocked when the ball 36 is dropped into the coupling 30. The ports 32 are connected to the central bore 17 by a cross bore 42. One end of cross bore 42 is sealed with a set screw at 44. The opposite end of cross bore 42 has a enlarged diameter adapted for receiving a rupture disc 46.

Figure 4:
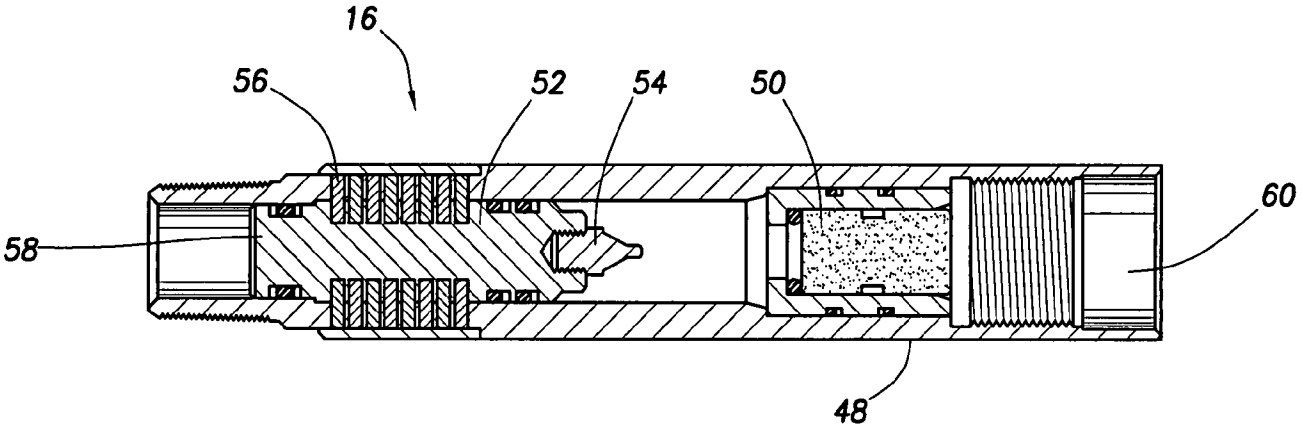
FIG. 4 is a cross sectional illustration of a pressure activated firing head according to an embodiment of the invention.

FIG. 4 is a cross sectional illustration of a pressure activated firing head 16 suitable for use in the present invention. The firing head 16 may be a conventional pressure actuated firing head sold as part number 100005224 by Halliburton Energy Services, Inc. The firing head 16 comprises four components. It includes a cylindrical housing 48, preferably made of steel, in which the other components are assembled. A percussion initiation charge 50 is contained in one end of the housing 48. A firing piston 52 is carried in the opposite end of the housing 48. The piston 52 carries a firing pin 54 positioned to impact the charge 50. A number of shear pins 56 hold the piston 52 in its unfired position as illustrated. The shear pins are selected to set the amount of force which must be applied to the outer surface 58 of the piston 52 in order to shear the pins 56 and drive the piston 52 into contact with the charge 50 activating the firing head. An internally threaded coupling 60 is provided on one end of the firing head housing 48 for coupling to the adapter 20.

Figure 5:
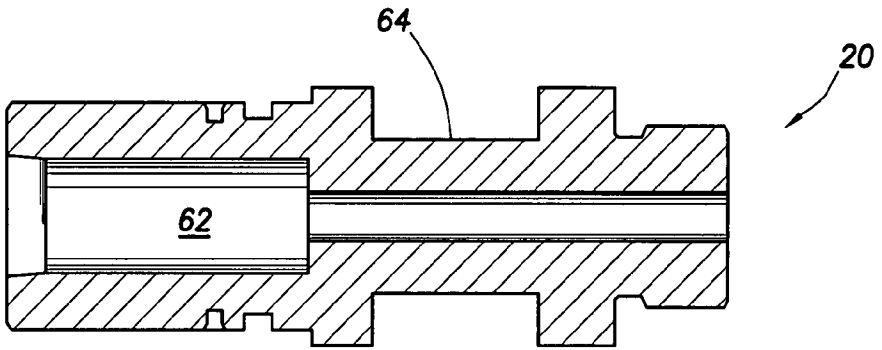
FIG. 5 is a cross sectional illustration of an adapter according to an embodiment of the invention.

FIG. 5 is a cross sectional illustration of the adapter 20. The adapter 20 is basically a hollow steel cylinder threaded on both ends for attachment to the firing head 16 and an inner threaded bore in the shaped charge 18 extension 24. A central bore 62 through the adapter 20 couples the explosive output of the firing head 16 to the shaped charge 18. The external surface of the adapter 20 has an elongated recess 64 for receiving set screws placed in threaded bores 22 in the crossover 12.

One suitable shaped charge 18 is a conventional shaped charge sold as part number 100157002 by Halliburton Energy Services Inc. The shaped charge 18 may contain from about one pound to about ten pounds of explosive material. The shaped charge explosive is of the secondary type, which requires a primary or initiating charge to detonate. The firing head 16 provides the primary charge. The shaped charge 18 includes a relatively soft metal, e.g. aluminum, housing for protecting the explosive materials while the charge is conveyed downhole. However, if desired, the housing may be made of non-metallic materials, for example a ceramic material or polymer based material. In a junk shot, the shaped charge is positioned to fire a jet down the borehole to break up or destroy any obstruction located in the well.

With reference to all the figures, methods of assembly and use of the present invention will be described. The crossover 12 and adapter 20 are formed from steel bars or tubing, for example by machining operations. A suitable pressure activated firing head 16 is selected and assembled with shear pins 56 selected to provide a safe firing pressure. The firing pressure should be well above the ambient downhole pressure at the location of a borehole obstruction which needs to be cleared plus pressure generated by circulation of drilling mud. The firing head is then threaded onto one end of the adapter 20. The other end of the adapter 20 is threaded into an internally threaded bore in extension 24 of the shaped charge 18.

The crossover 12 coupling 30 is then threaded onto a pin coupling on the lower end of a work string, e.g. jointed drill pipe or coiled tubing. The assembled firing head 16 and adapter 20 are then inserted into the bore 17 of the crossover 12. The threaded extension 24 of the shaped charge 18 is then threaded into the coupling 26 in the crossover 12. Setscrew 28 is then tightened against the extension 24 to prevent the charge 18 from being accidentally unscrewed from the crossover 12. Setscrews are also inserted into the bores 22 until their lower ends are positioned within the recess 64 in the adapter 20. These setscrews are preferably not tightened against the adapter 20. Instead they allow the adapter 20 to move axially a limited amount, but prevent it from dropping out of the crossover 12 after the charge has been fired. While the upper end of the firing head 16 may be threaded, there are no mating treads in the bore 17 of crossover 12.

Once the junk shot 10 has been assembled, it may be conveyed downhole on the end of the workstring. As this is done, drilling mud, or other well fluid, is pumped through the workstring. The fluid is jetted through the ports 34 to fluidize and circulate out of the borehole any solids or semi-solids which may have settled in the borehole or on its walls while preparations were made to clear an obstruction. As noted above, it is likely that a layer of particulates settled on top of the obstruction after the equipment failure which caused the obstruction. The charge 18 is preferably conveyed downhole until it actually is in contact with the obstruction.

When the charge 18 is in position on the obstruction, the charges may be fired. FIG. 1 illustrates one method of firing the charges. The ball 36 may be inserted into the work string at the surface and allowed to drop into the crossover 12 as shown. Continued circulation of fluid will facilitate moving the ball 36 downhole more quickly. When the ball enters the coupling 30, it blocks the flow of fluid through the jetting ports 34. In this configuration, there are no other flow paths for the drilling fluid to exit the crossover 12. The fluid pressure may be increased in the work string until the force applied through ports 32 to the surface 58 of the piston 52 is sufficient to shear the pins 56 and drive the piston 52 into contact with the primary explosive charge 50 causing it to detonate. The output of firing head 16 is conveyed through the adapter 20 to the shaped charge 18 which then fires.

Upon firing of the shaped charge 18, it essentially disintegrates. Its outer housing is made of relatively soft metal, e.g. aluminum or brass, or non-metallic materials such as ceramic or a polymer based material. This housing shatters or melts and remains in the borehole. But since it is soft or easily crushed material, it does not interfere with continued drilling. The firing head 16 and adapter 20 are preferably made of steel and are preferably not left in the borehole. The setscrews 22 fit loosely into the recess 64 in adapter 20. Upon firing of the shaped charge, the explosive force will drive the adapter 20 and firing head 16 upward to some extent. The bore 17 in crossover 12 is preferably tapered at its upper end so that the firing head housing 48 is driven into a press fit contact with the bore 17 when the charges are fired. This fit helps keep the firing head housing 48 from dropping out of the crossover 12. The setscrews 22 also prevent the adapter from dropping out, which in turn prevents the firing head housing 48 from dropping out.

The explosive force of firing the shaped charge 18 may also rupture the rupture disc 46. If it does not, the pressure in the work string may be increased sufficiently to rupture the disc 46. The disc 46 is selected to rupture at a pressure above the pressure needed to fire the firing head 16. It is desirable to rupture the disc 46 before removing the work string from the borehole. This provides a fluid circulation path, so that drilling fluid may drain from the work string as it is removed from the well.

While the above described embodiment uses a ball 36 and fluid pressure in the work string to fire the firing head 16, other methods may be used to fire the firing head 16. Any method of applying sufficient force to the surface 58 of the piston 52 will detonate the firing head 16. For example, it may be possible to simply increase the flow rate of the drilling fluid pumps sufficiently to created enough pressure to move piston 52. A high viscosity pill or slug could be injected into the work string. When the high viscosity slug enters the jetting ports 34, the pressure required to maintain flow will increase and will be applied to the firing head 16. The firing head 16 could also be fired by direct application of force to the piston 52, for example by drop device such as a go devil. The cross over 12 may be modified to allow a device dropped down the work string to make direct contact with the piston 52. The firing head need not be of the type having a piston. Other mechanically actuated firing heads or detonators may be used if desired. In any case, the pipe used to convey the junk shot down hole may be used to apply the force to the firing head so that a second trip with a work string, wireline, slickline, or the like is not required to fire the explosive charge.

While the present invention has been illustrated and described with reference to particular embodiments and methods of use, it is apparent that various changes in the apparatus and methods of making and use can be made within the scope of the present invention as defined by the appended claims.

What we claim as our invention is:

1. A junk shot for clearing an obstruction in a borehole, comprising:

a shaped charge positioned to fire a jet down a borehole, a force activated firing charge coupled to the shaped charge, and a crossover connected to the shaped charge having a coupling adapted for connection to an end of a pipe string and having an inner bore for receiving the firing charge, the inner bore being in fluid communication with a fluid flow path through the pipe string.

2. A junk shot according to claim 1, further comprising: one or more fluid circulation ports having a first end in fluid communication with the fluid flow path through the pipe string and a second end at an external surface of the crossover.

3. A junk shot according to claim 2, wherein the circulation port or ports are sized and positioned to direct a flow of fluid down a borehole when the junk shot is operatively positioned in a borehole.

4. A junk shot according to claim 2 further comprising means for selectively blocking fluid flow through the one or more circulation ports.

5. A junk shot according to claim 4, wherein the means for blocking is a ball.

6. A method for clearing an obstruction in a borehole, comprising:

providing a shaped charge of sufficient size to break up an obstruction in a borehole, coupling a pressure actuated firing head to the shaped charge, coupling the shaped charge to the lower end of a pipe string, exposing the firing head to the pressure of fluid within the pipe string, positioning the shaped charge adjacent an obstruction in a borehole and directed to fire a jet down the borehole, and increasing the pressure of fluid within the pipe string.

7. The method of claim 6, further comprising;

circulating fluid down the pipe string, removing particulates in the borehole below the shaped charge by jetting the fluid down the borehole through ports near the shaped charge, and flowing the fluid and particulates back up the borehole.

8. The method of claim 7, further comprising blocking the flow of fluid through the ports.

9. The method of claim 8, further comprising dropping a ball down the pipe string.

10. A method of firing an explosive charge in a borehole, comprising:

providing an explosive charge adapted for firing in a borehole, coupling a pressure actuated firing head to the explosive charge, coupling the explosive charge to the lower end of a pipe string, exposing the firing head to the pressure of fluid within the pipe string, conveying the explosive charge into the borehole while removing particulates in the borehole below the explosive charge by circulating fluid through the pipe string, jetting the fluid down the borehole through ports near the explosive charge, and flowing the fluid and particulates up the borehole, and increasing the pressure of fluid within the pipe string to a level sufficient to activate the firing head.

11. A method according to claim 10, further comprising blocking the flow of fluid through the ports.

12. The method of claim 11, further comprising dropping a ball down the pipe string.

* * * * *